US008419382B2

(12) United States Patent
Sato et al.

(10) Patent No.: US 8,419,382 B2
(45) Date of Patent: Apr. 16, 2013

(54) PISTON COMPRESSOR

(75) Inventors: Shinichi Sato, Aichi-ken (JP); Manabu Sugiura, Aichi-ken (JP); Toshiyuki Kobayashi, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 342 days.

(21) Appl. No.: 12/692,420

(22) Filed: Jan. 22, 2010

(65) Prior Publication Data

US 2010/0189576 A1 Jul. 29, 2010

(30) Foreign Application Priority Data

Jan. 23, 2009 (JP) ..... P2009-013428

(51) Int. Cl.
*F04B 27/10* (2006.01)

(52) U.S. Cl.
USPC ..... 417/269; 91/499; 91/501; 92/71

(58) Field of Classification Search ..... 417/269; 92/71; 91/499, 501
See application file for complete search history.

(56) References Cited

U.S. PATENT DOCUMENTS

| | | | | |
|---|---|---|---|---|
| 5,478,212 | A * | 12/1995 | Sakai et al. | 417/269 |
| 6,988,875 | B2 * | 1/2006 | Shintoku et al. | 417/269 |
| 2007/0292279 | A1 * | 12/2007 | Wakita et al. | 417/269 |
| 2009/0097999 | A1 * | 4/2009 | Ishikawa et al. | 417/534 |
| 2010/0003146 | A1 * | 1/2010 | Sato et al. | 417/269 |

FOREIGN PATENT DOCUMENTS

JP 2003247488 A 9/2003

* cited by examiner

*Primary Examiner* — Peter J Bertheaud
*Assistant Examiner* — Dominick L Plakkoottam
(74) *Attorney, Agent, or Firm* — Woodcock Washburn LLP

(57) ABSTRACT

A compressor includes a rotary shaft, a cam, a cylinder block, pistons, a thrust bearing, a rotary valve, and an oil passage. The rotary shaft has an in-shaft passage formed therein. The in-shaft passage has an outlet open to the outer peripheral surface of the rotary shaft. The cam rotates integrally with the rotary shaft. The pistons are coupled to the rotary shaft through the cam. The thrust bearing is provided between the cam and the cylinder block. The thrust bearing includes a first race in contact with the cam, a second race in contact with the cylinder block, and rolling elements retained between the first and second races to form a gap therebetween. The oil passage is formed in the outer peripheral surface of the rotary shaft so as to extend from the gap to the outlet of the in-shaft passage.

11 Claims, 9 Drawing Sheets

PISTON COMPRESSOR

CROSS REFERENCE TO RELATED APPLICATION

This application claims priority to Japanese Application No. 2009-013428 filed Jan. 23, 2009.

BACKGROUND

The present invention relates to a piston compressor with a lubrication mechanism, which includes a rotary valve rotated integrally with a rotary shaft and having a supply passage for introducing refrigerant from suction-pressure region of the compressor into a compression chamber defined in a cylinder bore by a piston.

A conventional piston type compressor using a rotary valve is disclosed in Japanese Unexamined Patent Application Publication No. 2003-247488. The compressor has a double-headed piston accommodated in paired front and rear cylinder bores of front and rear cylinder blocks, respectively. The piston forms compression chambers in the respective front and rear cylinder bores. The piston is reciprocated in the paired cylinder bores with the rotation of a swash plate rotating integrally with a rotary shaft of the compressor.

The rotary shaft is formed integrally with front and rear rotary valves. The rotary shaft has an in-shaft passage formed therein. The in-shaft passage has two outlets that form a part of the respective front and rear rotary valves. Each of the front and rear cylinder blocks is formed with suction ports that communicate with the respective compression chambers. The outlets of the in-shaft passage are intermittently communicable with the associated suction ports, with the rotation of the rotary shaft, that is, the rotation of the rotary valve. When the outlet of the in-shaft passage communicates with the suction port, refrigerant in the in-shaft passage is introduced into the compression chamber.

The in-shaft passage communicates with a suction chamber that is formed in a rear housing of the compressor. Refrigerant in the suction chamber is introduced through the in-shaft passage into the compression chambers in the respective front and rear cylinder bores. Refrigerant in the compression chamber of the front cylinder bore is discharged into a discharge chamber formed in a front housing of the compressor while pushing open a discharge valve. Refrigerant in the compression chamber of the rear cylinder bore is discharged into a discharge chamber formed in the rear housing while pushing open a discharge valve.

The compressor has a front thrust bearing interposed between the swash plate and the front cylinder block, and a rear thrust bearing interposed between the swash plate and the rear cylinder block. The position of the swash plate is restricted between the front and rear cylinder blocks by the front and rear thrust bearings.

The rotary shaft has an oil hole and a pressure-relief hole formed therein, and these holes extend between the outer peripheral surface of the rotary shaft and the in-shaft passage. The in-shaft passage includes a small-diameter portion and a large-diameter portion on the front and rear sides thereof, respectively. The in-shaft passage further includes a step located at the boundary between the small diameter portion and the large diameter portion and facing the rear thrust bearing. The oil hole is located upstream of the step as viewed in refrigerant flowing direction, in facing relation to the rear thrust bearing. The pressure relief-hole is located at a position facing the front thrust bearing.

Part of refrigerant flowing into the in-shaft passage from the suction chamber impinges on the step, so that lubricating oil contained in the refrigerant is separated. Part of such lubricating oil is delivered through the oil hole into the rear thrust bearing by centrifugal force caused by the rotation of the rotary shaft, so that the rear thrust bearing is lubricated. When the pressure of the crank chamber accommodating therein the swash plate is increased, refrigerant existing in the crank chamber is delivered through the pressure-relief hole into the in-shaft passage, so that the front thrust bearing is lubricated by lubricating oil contained in such refrigerant.

In the above-described compressor, however, since flow path extending through the front thrust bearing and the pressure-relief hole is straight, lubricating oil contained in the refrigerant flowing in such flow path is not separated sufficiently. Therefore, the lubrication of the front thrust bearing located adjacent to the pressure-relief hole may not be sufficient.

The present invention is directed to an improved lubrication of a thrust bearing in a piston compressor.

SUMMARY

In accordance with an aspect of the present invention, a piston compressor includes a rotary shaft, a cam, a cylinder block, pistons, a thrust bearing, a rotary valve, and an oil passage. The rotary shaft has an in-shaft passage formed therein. The in-shaft passage has an outlet open to the outer peripheral surface of the rotary shaft. The cam rotates integrally with the rotary shaft and is accommodated in a cam chamber. The cylinder block has a plurality of cylinder bores located around the rotary shaft. The pistons are accommodated in the respective cylinder bores to form therein compression chambers. The pistons are coupled to the rotary shaft through the cam so that rotating motion of the rotary shaft is transmitted to the pistons. The thrust bearing is provided between the cam and the cylinder block. The thrust bearing includes a first race in contact with the cam, a second race in contact with the cylinder block, and rolling elements retained between the first and second races to form a gap therebetween. The rotary valve is provided for introducing refrigerant into the compression chambers. The rotary valve includes the outlet of the in-shaft passage. The refrigerant is introduced into the compressor and then delivered through the outlet of the in-shaft passage to the compression chambers. The oil passage is formed in the outer peripheral surface of the rotary shaft so as to extend from the gap to the outlet of the in-shaft passage.

Other aspects and advantages of the invention will become apparent from the following description, taken in conjunction with the accompanying drawings, illustrating by way of example the principles of the invention.

DETAILED DESCRIPTION OF ILLUSTRATIVE EMBODIMENTS

Figure 1:
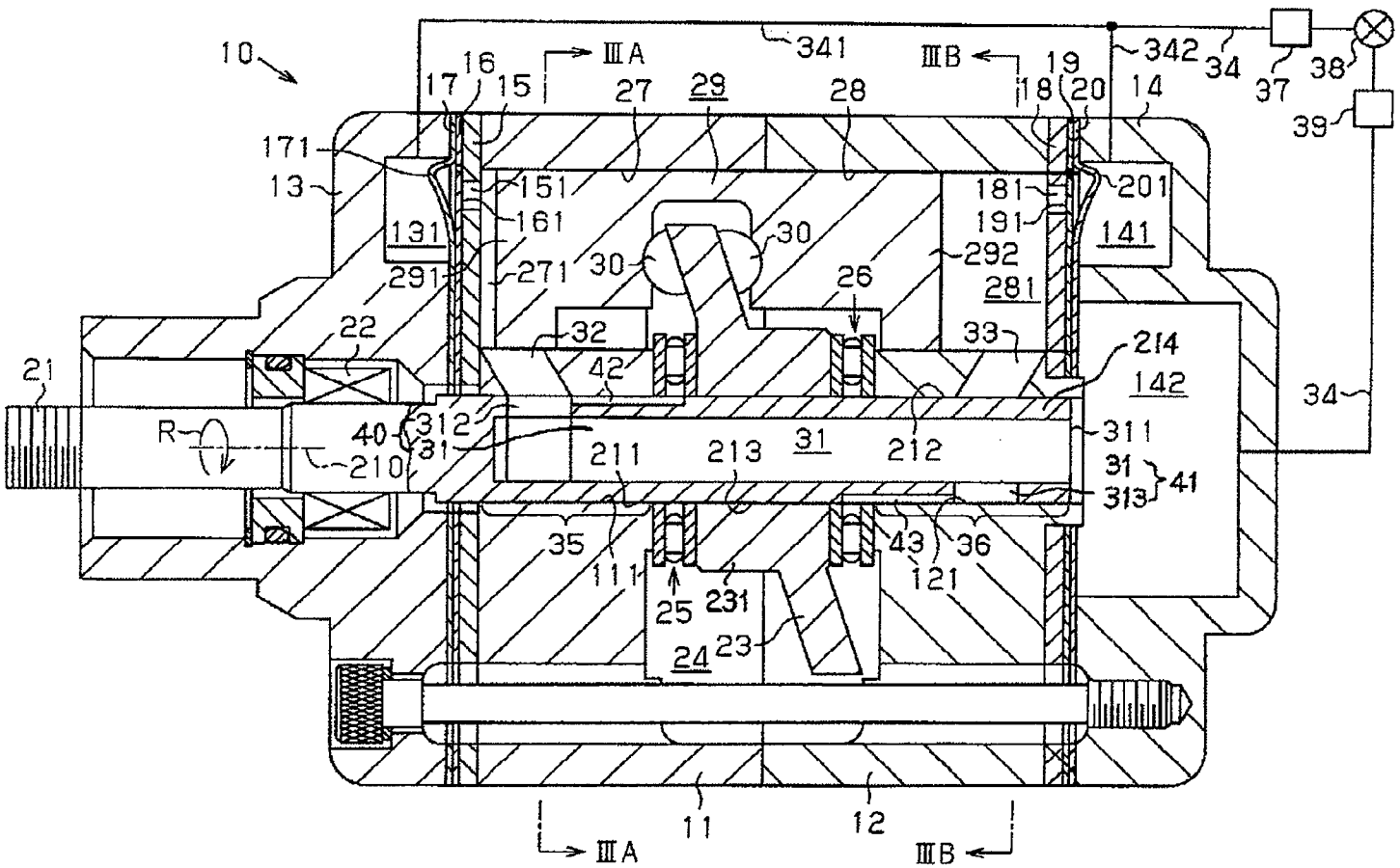
FIG. 1 is a longitudinal sectional view of a compressor according to a first embodiment of the present invention.

FIG. 1 shows a double-headed piston type compressor 10 according to the first embodiment of the present invention. It is noted that the left-hand side and the right-hand side as viewed in FIG. 1 are the front side and the rear side of the compressor 10, respectively. The compressor 10 has a pair of first and second cylinder blocks 11 and 12 that are connected to front and rear housings 13 and 14, respectively. The first cylinder block 11, the second cylinder block 12, the front housing 13 and the rear housing 14 cooperate to form a housing assembly of the compressor 10. The compressor 10 has discharge chambers 131 and 141 formed in the front and rear housings 13 and 14, respectively, and a suction chamber 142 formed in the rear housing 14. The suction chamber 142 serves as a suction-pressure region in the compressor 10.

The compressor 10 has a valve port plate 15, a valve plate 16 and a retainer plate 17 interposed between the first cylinder block 11 and the front housing 13. The compressor 10 further has a valve port plate 18, a valve plate 19 and a retainer plate 20 interposed between the second cylinder block 12 and the rear housing 14. The valve port plates 15 and 18 are formed with discharge ports 151 and 181, respectively. The valve plates 16 and 19 are formed with discharge valves 161 and 191 that close the discharge ports 151 and 181, respectively. The retainer plates 17 and 20 are formed with retainers 171 and 201 that regulate the opening of the discharge valves 161 and 191, respectively.

The first and second cylinder blocks 11 and 12 are formed therethrough with shaft holes 111 and 121, respectively, and a rotary shaft 21 is inserted through the shaft holes 111 and 121 and supported by the first and second cylinder blocks 11 and 12. The outer peripheral surface 213 of the rotary shaft 21 is in contact with the inner peripheral surfaces of the shaft holes 111 and 121. The rotary shaft 21 is supported directly on the inner peripheral surfaces of the shaft holes 111 and 121 of the first and second cylinder blocks 11 and 12. The outer peripheral surface 213 of the rotary shaft 21 has a sealing surface 211 that is in contact with the inner peripheral surface of the shaft hole 111 and a sealing surface 212 that is in contact with the inner peripheral surface of the shaft hole 121.

The compressor 10 has a swash plate 23 fixed to the rotary shaft 21 for rotation therewith and serving as a cam. The swath plate 23 is accommodated in a crank chamber 24 (cam chamber) that is formed by and between the first and second cylinder blocks 11 and 12. Leakage of refrigerant through the clearance between the front housing 13 and the rotary shaft 21 is prevented by a lip-type seal member 22 that is interposed between the front housing 13 and the rotary shaft 21. The front end of the rotary shaft 21 protruding out of the front housing 13 receives driving force from an external drive source such as a vehicle engine (not shown).

Figure 3A:
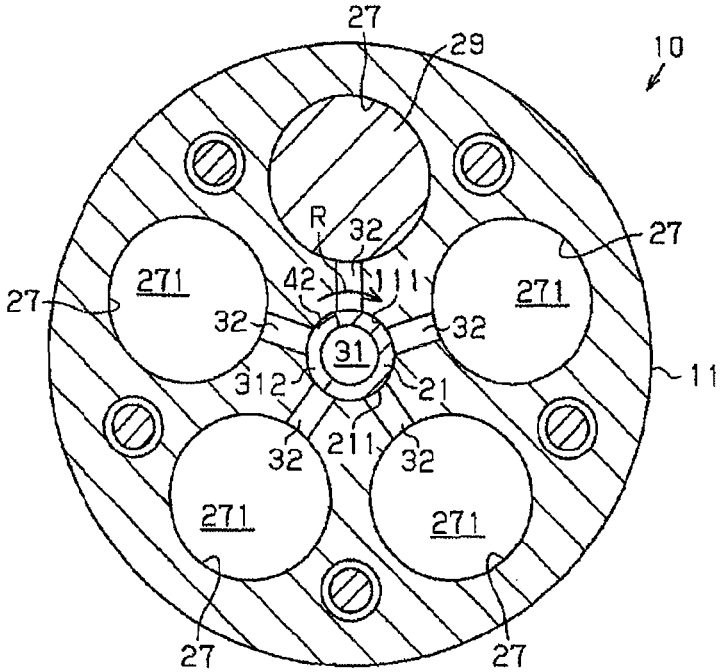
FIG. 3A is a cross-sectional view taken along the line IIIA-IIIA of FIG. 1.
Figure 3B:
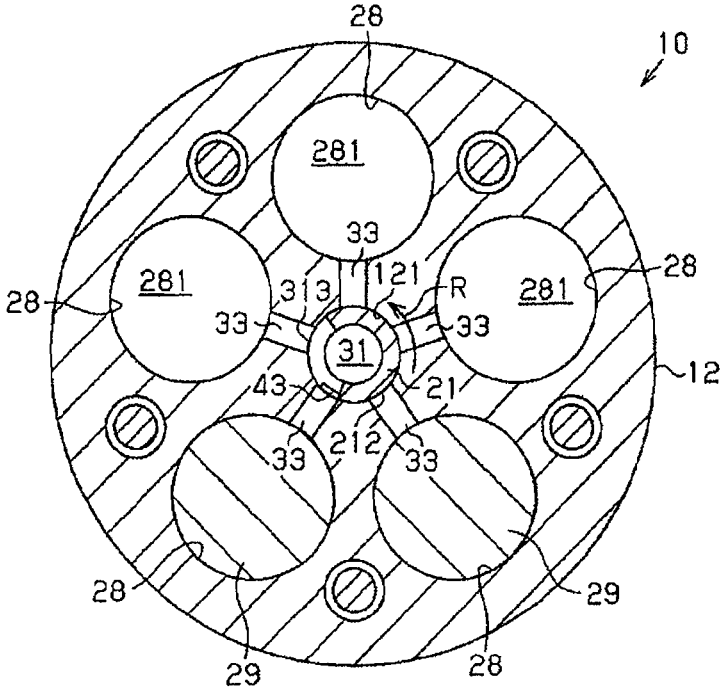
FIG. 3B is a cross-sectional view taken along the line IIIB-IIIB of FIG. 1.

Referring to FIGS. 3A and 3B, the first cylinder block 11 is formed with a plurality of first cylinder bores 27 arranged around the rotary shaft 21, and the second cylinder block 12 is formed similarly with a plurality of second cylinder bores 28 arranged around the rotary shaft 21. Each first cylinder bore 27 is paired with its opposite second cylinder bore 28 to accommodate therein a double-headed piston 29.

The rotating motion of the swash plate 23 rotating integrally with the rotary shaft 21 is transmitted to the double-headed piston 29 through a pair of shoes 30, so that the double-headed piston 29 reciprocates in its associated first and second cylinder bores 27 and 28. The double-headed piston 29 has cylindrical heads 291 and 292 on opposite ends thereof. The head 291 defines a first compression chamber 271 in the first cylinder bore 27, and the head 292 defines a second compression chamber 281 in the second cylinder bore 28.

The rotary shaft 21 is formed with an in-shaft passage 31 that extends along the rotational axis 210 of the rotary shaft 21. The rotary shaft 21 has an end portion 214 that is rotatably supported by the second cylinder block 12. The end portion 214 is located adjacent to the suction chamber 142 in the rear housing 14. The in-shaft passage 31 has an inlet 311 formed at the end portion 214. The in-shaft passage 31 is opened at the inlet 311 to the suction chamber 142 in the rear housing 14. The in-shaft passage 31 communicates with the suction chamber 142 only at the end portion 214 of the rotary shaft 21. That is, refrigerant is introduced into the in-shaft passage 31 only through the inlet 311.

The in-shaft passage 31 further has a first outlet 312 and a second outlet 313 formed in the outer peripheral surface 213 of the rotary shaft 21. The in-shaft passage 31 is opened at the first outlet 312 to the sealing surface 211 of the rotary shaft 21 in the shaft hole 111. The in-shaft passage 31 is opened at the second outlet 313 to sealing surface 212 of the rotary shaft 21 in the shaft hole 121.

Figure 2A:
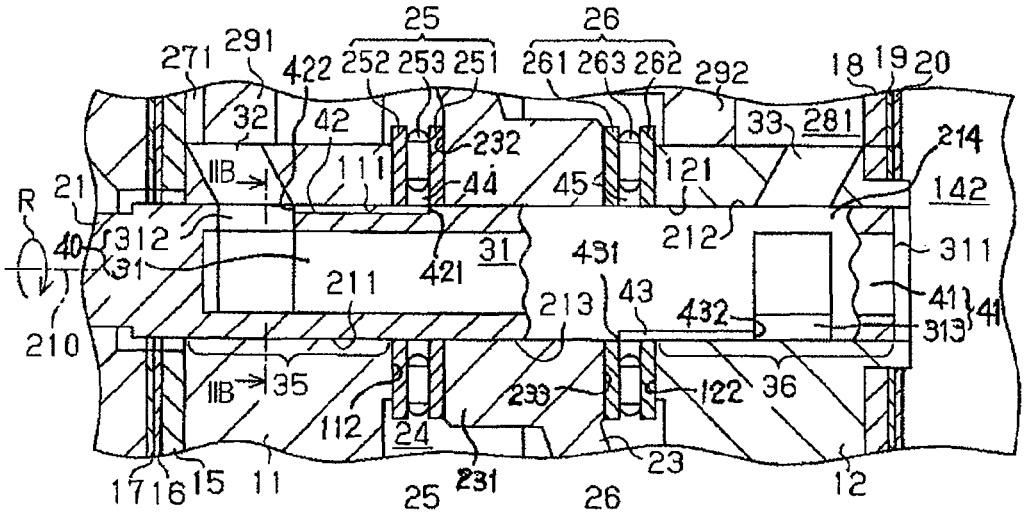
FIG. 2A is an enlarged fragmentary view of the compressor of FIG. 1.

As shown in FIGS. 2A and 3A, the first cylinder block 11 is formed with a plurality of first communication passages 32 that communicates with their associated first cylinder bores 27 and the shaft hole 111. As shown in FIGS. 2C and 3B, the second cylinder block 12 is formed with a plurality of second communication passages 33 that communicates with their associated second cylinder bore 28 and the shaft hole 121. As the rotary shaft 21 rotates, the first and second outlets 312 and 313 of the in-shaft passage 31 intermittently communicate with the first and second communication passages 32 and 33, respectively.

When the double-headed piston 29 is in the suction stroke for the first cylinder bore 27, that is, when the double-headed piston 29 is moving rightward in FIG. 1, the first outlet 312 is connected to the first communication passage 32. Refrigerant in the suction chamber 142 is introduced through the in-shaft passage 31, the first outlet 312 and the first communication passage 32 into the first compression chamber 271 in the first cylinder bore 27.

When the double-headed piston 29 is in the discharge stroke for the first cylinder bore 27, that is, when the double-headed piston 29 is moving leftward in FIG. 1, the first outlet 312 is disconnected from the first communication passage 32. Refrigerant in the first compression chamber 271 is discharged into the discharge chamber 131 through the discharge port 151 while pushing open the discharge valve 161. The refrigerant discharged into the discharge chamber 131 then flows into an external refrigerant circuit 34 through a passage 341.

When the double-headed piston 29 is in the suction stroke for the second cylinder bore 28, that is, when the double-headed piston 29 is moving leftward in FIG. 1, the second outlet 313 is connected to the second communication passage 33. Refrigerant in the suction chamber 142 is introduced through the in-shaft passage 31, the second outlet 313 and the second communication passage 33 into the second compression chamber 281 in the second cylinder bore 28.

When the double-headed piston 29 is in the discharge stroke for the second cylinder bore 28, that is, when the double-headed piston 29 is moving rightward in FIG. 1, the second outlet 313 is disconnected from the second communication passage 33. Refrigerant in the second compression chamber 281 is discharged into the discharge chamber 141 through the discharge port 181 while pushing open the discharge valve 191. The refrigerant discharged into the discharge chamber 141 then flows into the external refrigerant circuit 34 through a passage 342.

The external refrigerant circuit 34 includes a heat exchanger 37 for removing heat from refrigerant, an expansion valve 38, and a heat exchanger 39 for absorbing ambient heat. The expansion valve 38 controls the flow rate of refrigerant depending on the change of refrigerant temperature at the outlet of the heat exchanger 39. The refrigerant flowed through the external refrigerant circuit 34 then returns to the suction chamber 142 of the compressor 10. Lubricating oil is contained in and flows with refrigerant circulating through the compressor 10 and the external refrigerant circuit 34.

The sealing surface 211 of the rotary shaft 21 forms a first rotary valve 35, and the sealing surface 212 of the rotary shaft 21 forms a second rotary valve 36. The in-shaft passage 31 and the first outlet 312 form a first supply passage 40 for the first rotary valve 35, and the in-shaft passage 31 and the second outlet 313 form a second supply passage 41 for the second rotary valve 36.

As shown in FIGS. 2A and 2C, a first thrust bearing 25 is disposed between a base 231 of the swash plate 23 and the first cylinder block 11, and a second thrust bearing 26 is disposed between the base 231 and the second cylinder block 12. The first thrust bearing 25 has a ring-shaped race 251 (first race) in contact with the front end surface 232 of the base 231 of the swash plate 23, a ring-shaped race 252 (second race) in contact with the end surface 112 of the first cylinder block 11, and a plurality of rollers 253 (rolling elements) provided between the races 251 and 252. The rollers 253 are retained between the races 251 and 252 to form a gap 44 therebetween. As the swash plate 23 rotates, the rollers 253 roll while engaging with the races 251 and 252.

The second thrust bearing 26 has a ring-shaped race 261 (first race) in contact with the rear end surface 233 of the base 231 of the swash plate 23, a ring-shaped race 262 (second race) in contact with the end surface 122 of the second cylinder block 12, and a plurality of rollers 263 (rolling elements) provided between the races 261 and 262. The rollers 263 are retained between the races 261 and 262 to form a gap 45 therebetween. As the swash plate 23 rotates, the rollers 263 roll while engaging with the races 261 and 262.

The position of the swash plate 23 is restricted between the first and second cylinder blocks 11 and 12 by the first and second thrust bearings 25 and 26. As shown in FIGS. 2A and 28, the rotary shaft 21 has a groove 42 formed in the sealing surface 211 thereof which is part of the outer peripheral surface 213 of the rotary shaft 21. The groove 42, which serves as an oil passage (first oil passage), has an inlet 421 located at a position facing the gap 44 that is formed between the races 251 and 252 by the rollers 253 in the first thrust bearing 25. The groove 42 extends straight along the rotational axis 210 of the rotary shaft 21 so as to communicate with the gap 44 and the first outlet 312 of the in-shaft passage 31.

Figure 2B:
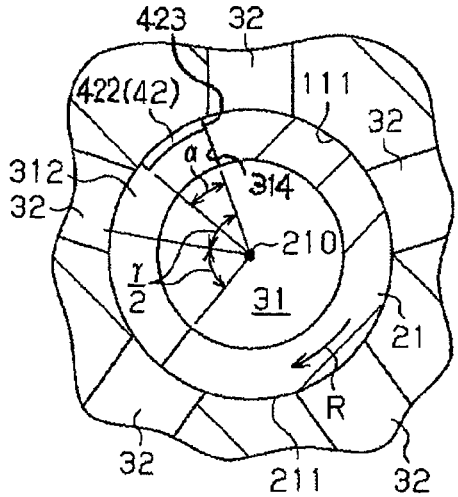
FIG. 2B is a cross-sectional view taken along the line IIB-IIB of FIG. 2A.
Figure 2C:
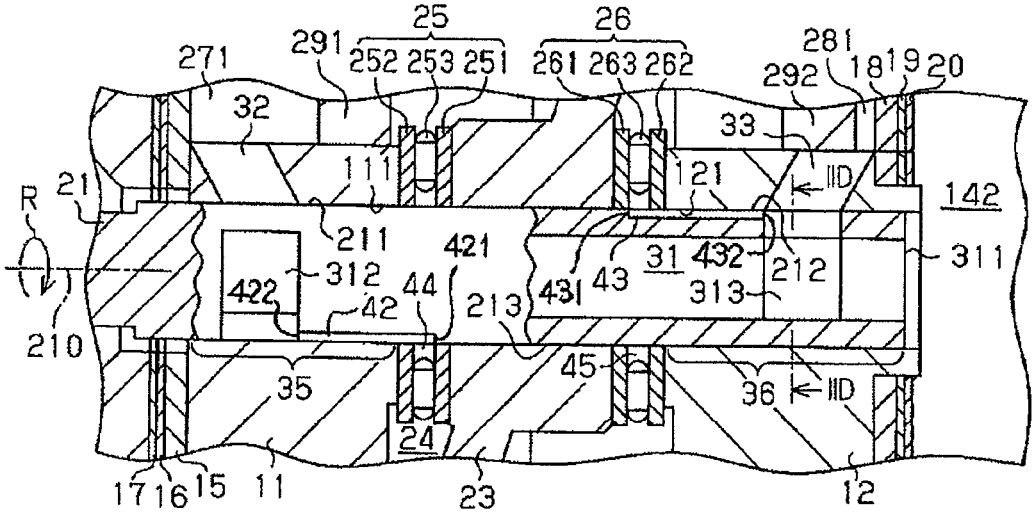
FIG. 2C is an enlarged fragmentary view of the compressor of FIG. 1.
Figure 2D:
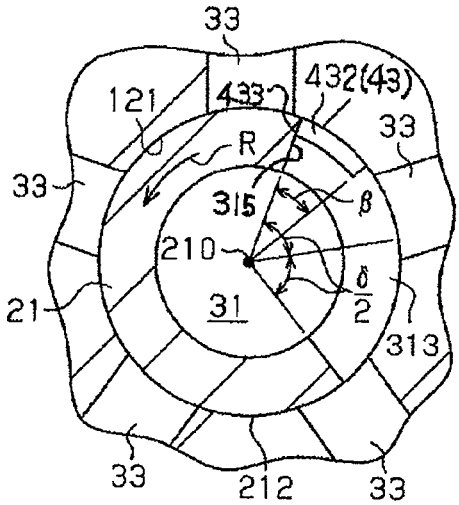
FIG. 2D is a cross-sectional view taken along the line IID-IID of FIG. 2C.

As shown in FIGS. 2C and 2D, the rotary shaft 21 has a groove 43 formed in the sealing surface 212 thereof which is part of the outer peripheral surface 213 of the rotary shaft 21. The groove 43, which serves as an oil passage (second oil passage), has an inlet 431 located at a position facing the gap 45 that is formed between the races 261 and 262 by the rollers 263 in the second trust bearing 26. The groove 43 extends straight along the rotational axis 210 of the rotary shaft 21 so as to communicate with the gap 45 and the second outlet 313 of the in-shaft passage 31.

FIGS. 2A and 2B show a state where the head 291 of the double-headed piston 29 is located at its top dead center, and FIGS. 2C and 2D show a state where the head 292 of the double-headed piston 29 is located at its top dead center. That is, FIGS. 2C and 2D show the position where the rotary shaft 21 and the swash plate 23 have been rotated by 180 degree from the position of FIGS. 2A and 2B. Arrow R in FIGS. 2A through 2D indicates rotational direction of the rotary shaft 21.

When the double-headed piston 29 is in the discharge stroke for the first cylinder bore 27, the pressure in the first compression chamber 271 defined by the head 291 is larger than suction pressure. Similarly, when the double-headed piston 29 is in the discharge stroke for the second cylinder bore 28, the pressure in the second compression chamber 281 defined by the head 292 is larger than suction pressure. Part of refrigerant existing in the first and second compression chambers 271 and 281 flows into the crank chamber 24 through the clearance between the outer peripheral surfaces of the heads 291 and 292 of the double-headed piston 29 and the inner peripheral surfaces of the first and second cylinder bores 27 and 28. Therefore, the pressure in the crank chamber 24 is larger than that in the in-shaft passage 31, the first and second outlets 312 and 313, and the first and second communication passages 32 and 33 where the pressure is substantially the same as suction pressure. Such pressure difference causes refrigerant in the crank chamber 24 to flow into the first outlet 312 and the first communication passage 32 through the gap 44 and the groove 42 and also into the second outlet 313 and the second communication passage 33 through the gap 45 and the groove 43.

The first thrust bearing 25 is lubricated by lubricating oil contained in the refrigerant flowing through the gap 44, the groove 42, the first outlet 312 and the first communication passage 32. The second thrust bearing 26 is lubricated by lubricating oil contained in refrigerant flowing through the gap 45, the groove 43, the second outlet 313 and the second communication passage 33.

As shown in FIG. 2B, the groove 42 has angular width a about the rotational axis 210. The groove 42 has an outlet 422 connected to the first outlet 312 of the in-shaft passage 31. The leading end 423 of the outlet 422 as viewed in the rotational direction R of the rotary shaft 21 coincides with the leading end 314 of the first outlet 312. The angular width $\alpha$ of the groove 42 is set so as to satisfy the relation $\alpha<\gamma/2$, where $\gamma$ is angular width of the first outlet 312 about the rotational axis 210.

As shown in FIG. 2D, the groove 43 has angular width 13 about the rotational axis 210. The groove 43 has an outlet 432 connected to the second outlet 313 of the in-shaft passage 31. The leading end 433 of the outlet 432 as viewed in the rotational direction R coincides with the leading end 315 of the second outlet 313. The angular width $\beta$ of the groove 43 is set so as to satisfy the relation $\beta<\delta/2$, where $\delta$ is angular width of the second outlet 313 about the rotational axis 210. In the present embodiment, the following conditions are satisfied: $\alpha=\beta$ and $\gamma=\delta$.

Figure 4:
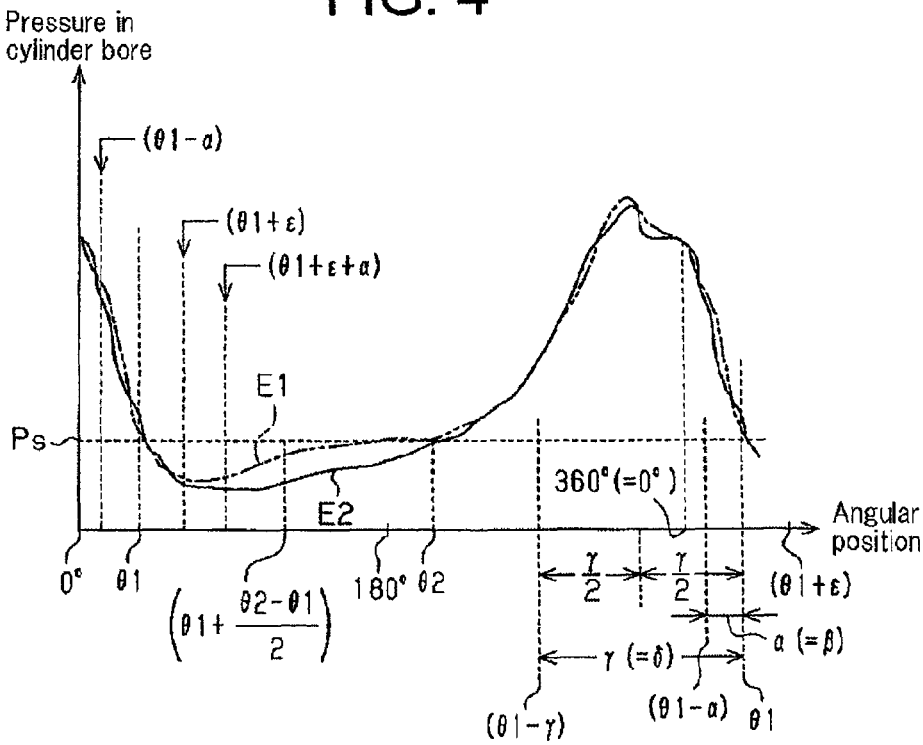
FIG. 4 is a graph showing pressure changes in a cylinder bore of the compressor of FIG. 1.

FIG. 4 is a graph showing pressure changes in the first communication passage 32 and the first cylinder bore 27. The curve E1 shows pressure change in a condition where the compressor is operating at a low speed, and the curve E2 shows pressure change in a condition where the compressor is operating at a high speed. The horizontal axis represents angular position of the rotary shaft 21, and the vertical axis represents pressure in the first communication passage 32 and the first cylinder bore 27. Angular position 01 shows the timing of the start of the fluid communication between one of the first communication passages 32 and the first outlet 312. Angular position $\theta2$ shows the timing of the end of the fluid communication between the first communication passage 32 and the first outlet 312. The angular position $\theta1$ also shows the timing of the start of the fluid communication between the groove 42 and the first communication passage 32. In either case of the high-speed or low-speed operation of the compressor, the first communication passage 32 and the first cylinder bore 27 has the lowest pressure within the range $[\theta1, \theta1+(\theta2-\theta1/2)]$ that is the first half of the range $[\theta1, \theta2]$. Pressure changes in the second communication passage 33 and the second cylinder bore 28 are also similar to those shown in FIG. 4.

Referring to FIG. 4, the first outlet 312 with angular width y is located within the range $[\theta1-\gamma, \theta1]$ at the timing of the start of the fluid communication between the first outlet 312 and the first cylinder bore 27. The groove 42 with angular width a is located within the range $[\theta1-\alpha, \theta1]$ at the timing of the start of the fluid communication between the first outlet 312 and the first communication passage 32.

Referring to FIG. 4, $\epsilon$ represents angular width of the first communication passage 32 about the rotational axis 210. The first communication passage 32 with angular width $\epsilon$ is located within the range $[\theta1, \theta1+\epsilon]$. Angular position $(\theta1+\epsilon+\alpha)$ represents the timing of the end of the fluid communication between the groove 42 and the first communication passage 32. That is, the groove 42 communicates with the first communication passage 32 within the range $[\theta1, \theta1+\epsilon+\alpha]$.

Referring to FIG. 4, Ps represents pressure in the suction chamber 142, that is, suction pressure. Since the first communication passage 32 and the first cylinder bore 27 has the lowest pressure within the range $[\theta1, \theta1+\epsilon+\alpha]$, pressure difference between the crank chamber 24 and the first cylinder bore 27 becomes largest within the range $[\theta1, \theta1+\epsilon+\alpha]$. Therefore, the amount of refrigerant flowing through the gap 44, the groove 42, the first outlet 312 and the first communication passage 32 becomes largest, so that the first thrust bearing 25 is lubricated efficiently by lubricating oil contained in the refrigerant. The same is true of the second communication passage 33, the second cylinder bore 28 and the groove 43.

The compressor 10 according to the first embodiment of the present invention offers the following advantages.

(1) In the case where the pressure in the crank chamber 24 is larger than suction pressure and the first and second outlets 312 and 313 are connected to the compression chambers 271 and 281, refrigerant in the crank chamber 24 flows through the gaps 44 and 45, the grooves 42 and 43, the first and second outlets 312 and 313, and the first and second communication passages 32 and 33 into the compression chambers 271 and 281, in this case, since flow path of the refrigerant does not include the in-shaft passage 31, pressure loss becomes smaller, as compared to the case where the refrigerant flows through the in-shaft passage 31. As a result, the amount of refrigerant flowing through the gaps 44 and 45 and the grooves 42 and 43 is increased, which allows sufficient lubrication of the thrust bearings 25 and 26.

(2) The grooves 42 and 43 are located within the range $[\theta1-\gamma/2, \theta1]$, which is the first half of the angular width $\gamma(=\delta)$ of the first and second outlets 312 and 313. That is, the outlets 422 and 432 of the grooves 42 and 43 are connected to the first half of the first and second outlets 312 and 313, respectively, as seen in the rotational direction R of the rotary shaft 21. This allows efficient lubrication of the first and second thrust bearings 25 and 26 by lubricating oil in refrigerant.

(3) The grooves 42 and 43 are provided for the first and second thrust bearings 25 and 26, respectively, which allows the first and second thrust bearings 25 and 26 to be lubricated evenly.

Figure 5A:
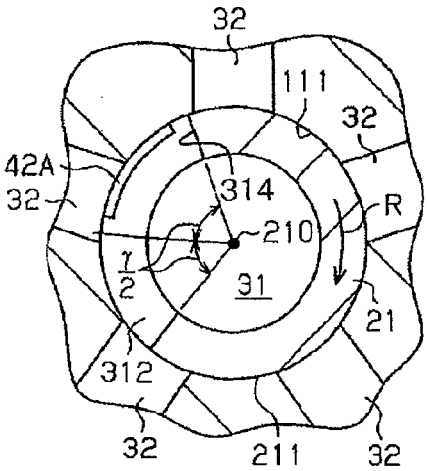
FIG. 5A is a fragmentary sectional view of a compressor according to a second embodiment of the present invention.
Figure 5B:
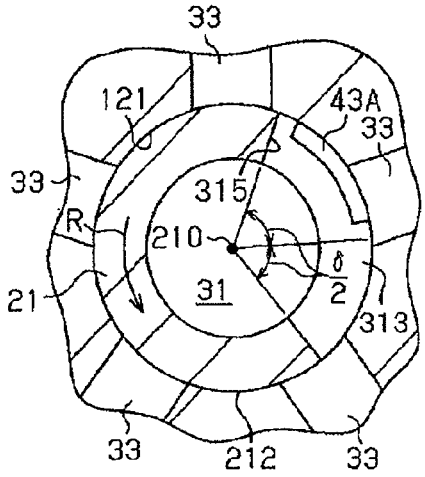
FIG. 5B is a fragmentary sectional view of the compressor according to the second embodiment of the present invention.
Figure 6A:
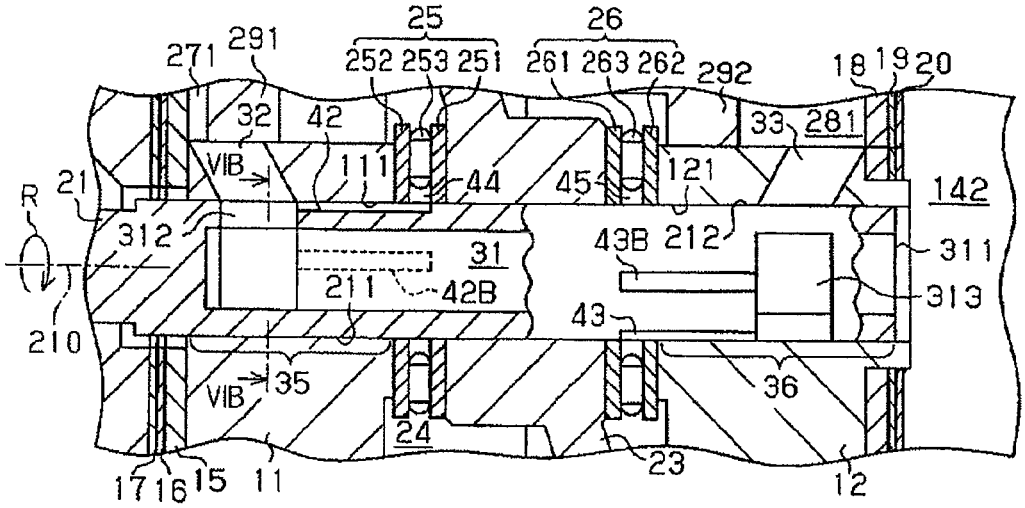
FIG. 6A is a fragmentary sectional view of a compressor according to a third embodiment of the present invention.

FIGS. 6A and 5B show the second embodiment of the present invention. In the drawings, same reference numerals are used for the common elements or components in the first and second embodiments, and the description of such elements or components for the second embodiment will be omitted. FIG. 5A shows a state where the head 291 of the double-headed piston 29 is located at the top dead center, and FIG. 5B shows a state where the head 292 of the double-headed piston 29 is located at the top dead center. In the second embodiment, the groove 42A formed in the sealing surface 211 of the rotary shaft 21 is located away from the leading end 314 of the first outlet 312 as seen in the rotational direction R of the rotary shaft 21 and located within the range of the first half of the angular width $\gamma$ of the first outlet 312. Similarly, the groove 43A formed in the sealing surface 212 of the rotary shaft 21 is located away from the leading end 315 of the second outlet 313 and located within the range of the first half of the angular width $\delta(=\gamma)$ of the second outlet 313. The second embodiment offers the advantages similar to those of the first embodiment.

FIGS. 6A, 6B, 6C and 6D show the third embodiment of the present invention. In the drawings, same reference numerals are used for the common elements or components in the first and third embodiments, and the description of such elements or components for the third embodiment will be omitted.

Figure 6B:
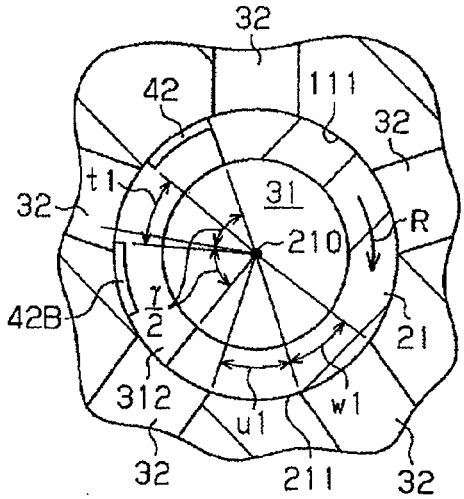
FIG. 6B is a cross-sectional view taken along the line VIB-VIB of FIG. 6A.
Figure 6C:
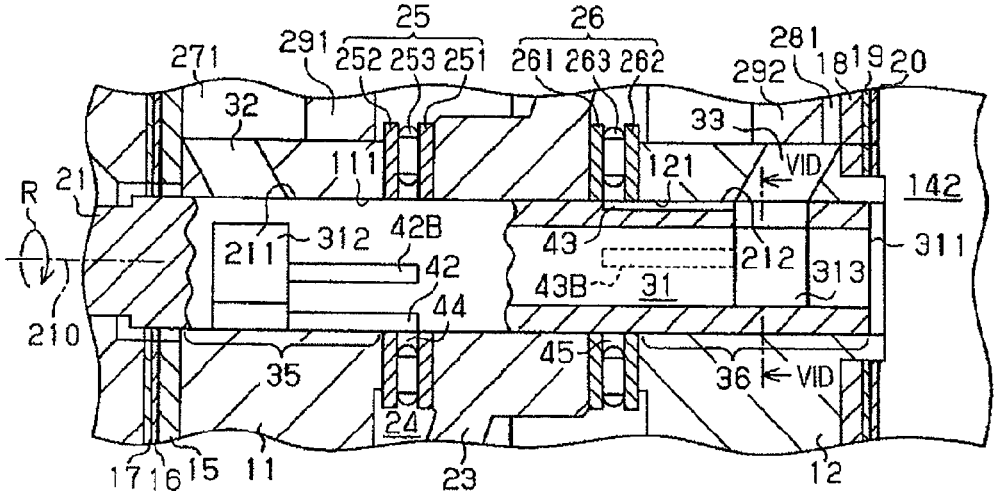
FIG. 6C is a fragmentary sectional view of the compressor according to the third embodiment of the present invention.
Figure 6D:
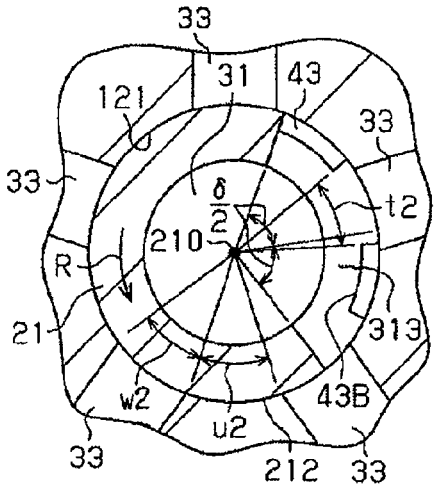
FIG. 6D is a cross-sectional view taken along the line VID-VID of FIG. 6C.

FIGS. 6A and 6B show a state where the head 291 of the double-headed piston 29 is located at the top dead center, and FIGS. 6C and 6D show a state where the head 292 of the double-headed piston 29 is located at the top dead center. In the third embodiment, an additional groove 42B is formed in the sealing surface 211 of the rotary shaft 21 so as to extend parallel to the groove 42, and another additional groove 43B is formed in the sealing surface 212 of the rotary shaft 21 so as to extend parallel to the groove 43.

Angular interval t1 between the adjacent grooves 42 and 42B is set so as to satisfy the relation $u1 \leqq t1 \leqq u1+w1$, where u1 is angular interval between the adjacent first communication passages 32 about the rotational axis 210, and w1 is angular width of the first communication passage 32 about the rotational axis 210. Additionally, angular interval 12 between the adjacent grooves 43 and 43B is set so as to satisfy the relation u2≦t2≦u2+w2, where u2 is angular interval between the adjacent second communication passages 33 about the rotational axis 210, and w2 is angular width of the second communication passage 33 about the rotational axis 210.

With the angular intervals t1 and t2 thus set, at least one of the grooves 42 and 42B communicates with at least one of the first communication passages 32, and at least one of the grooves 43 and 43B communicates with at least one of the second communication passages 33. Therefore, the first cylinder bore 27 always communicates with the crank chamber 24 through the grooves 42 and 428, and the second cylinder bore 28 always communicates with the crank chamber 24 through the grooves 43 and 43B. This contributes to improved lubrication of the thrust bearings 25 and 26.

Figure 7A:
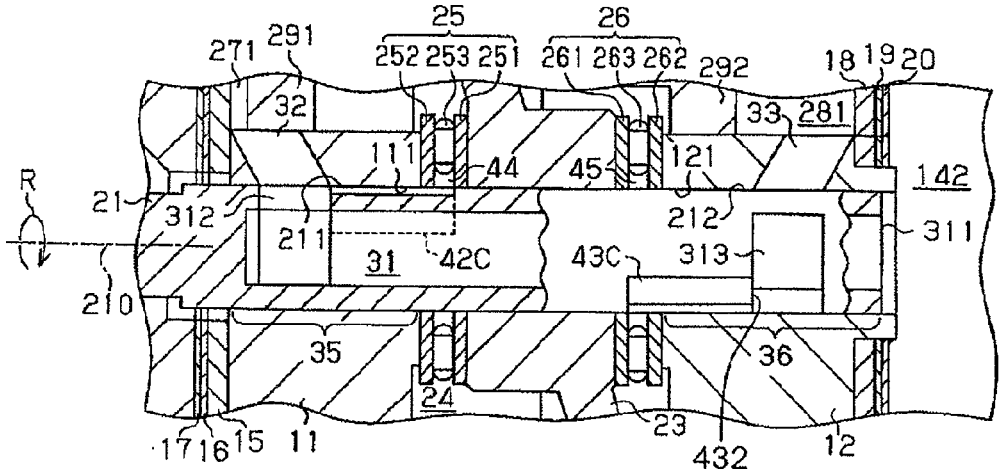
FIG. 7A is a fragmentary sectional view of a compressor according to a fourth embodiment of the present invention.
Figure 7B:
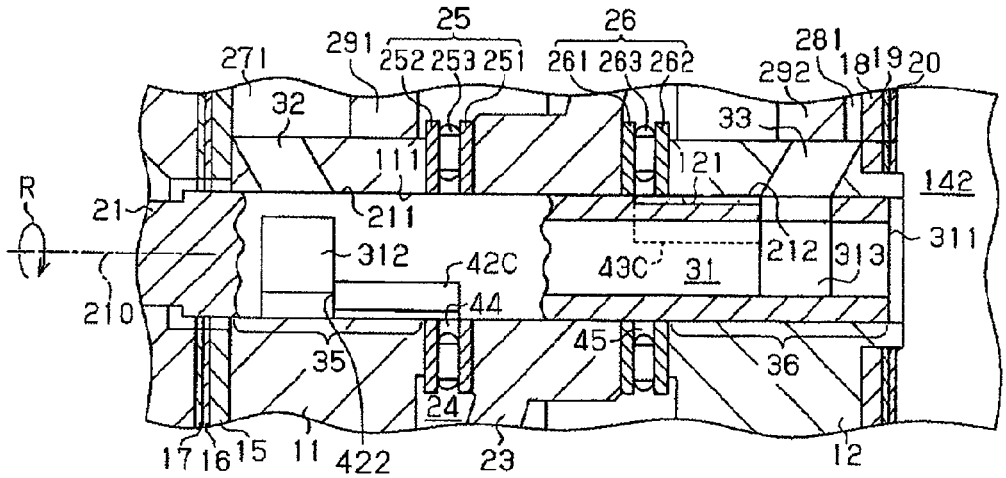
FIG. 7B is a fragmentary sectional view of the compressor according to the fourth embodiment of the present invention.

FIGS. 7A and 7B show the fourth embodiment of the present invention. In the drawings, same reference numerals are used for the common elements or components in the first and fourth embodiments, and the description of such elements or components for the fourth embodiment will be omitted. FIG. 7A shows a state where the head 291 of the double-headed piston 29 is located at the top dead center, and FIG. 7B shows a state where the head 292 of the double-headed piston 29 is located at the top dead center. In the fourth embodiment, the angular width of the groove 42C about the rotational axis 210 is larger than the angular width of the groove 43C about the rotational axis 210. That is, the cross-sectional area of the groove 42C is larger than that of the groove 43C. As in the previous embodiments, the outlet 422 of the groove 42C is located within the range of the first half of the angular width γ of the first outlet 312, and the outlet 432 of the groove 43C is located within the range of the first half of the angular width δ of the second outlet 313.

The pressure in the region of the first outlet 312 is slightly higher than that in the region of the second outlet 313. The difference of the cross-sectional area between the grooves 42C and 43C allows refrigerant to flow through the grooves 42C and 43C evenly. Further, the cross-sectional area of the groove 42C is larger than that of the groove 43C, which allows the first and second thrust bearings 25 and 26 to be lubricated evenly.

Figure 8A:
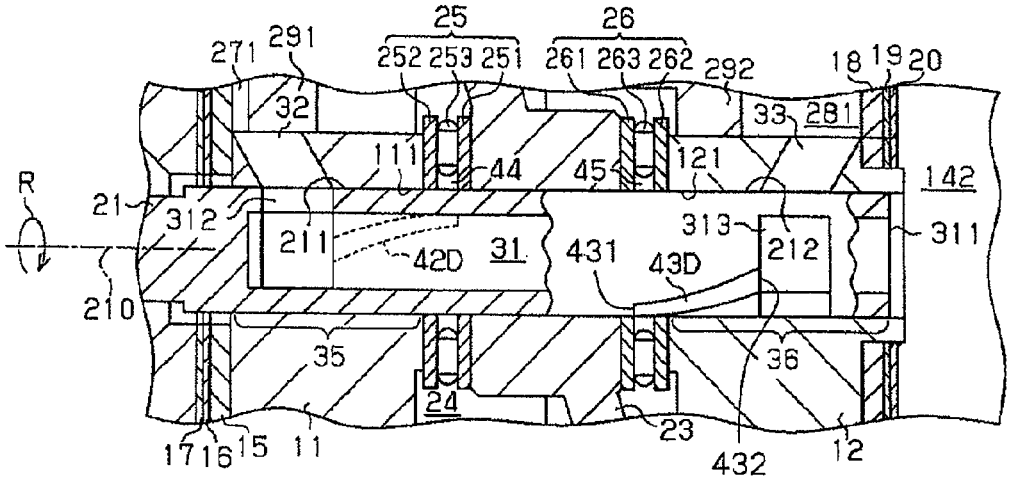
FIG. 8A is a fragmentary sectional view of a compressor according to a fifth embodiment of the present invention.
Figure 8B:
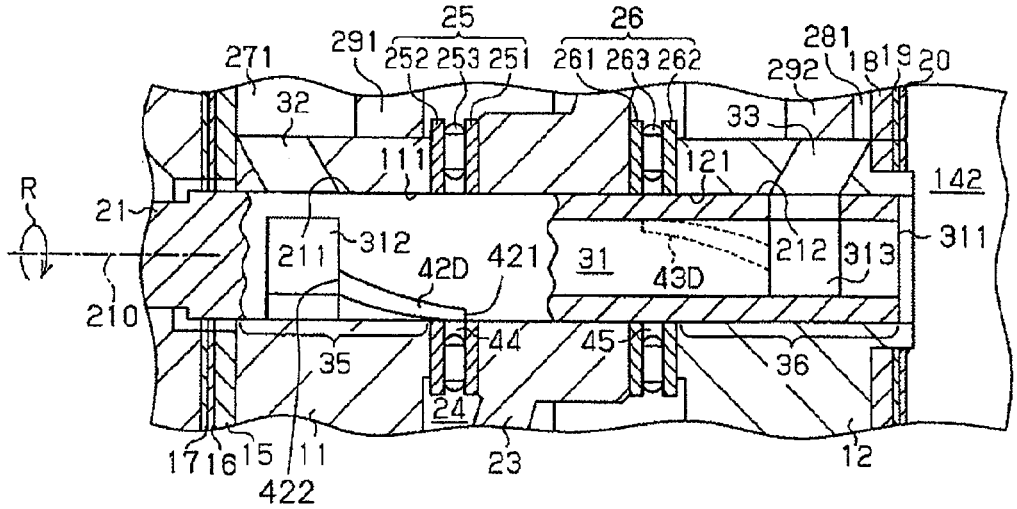
FIG. 8B is a fragmentary sectional view of the compressor according to the fifth embodiment of the present invention.

FIGS. 8A and 8B show the fifth embodiment of the present invention. In the drawings, same reference numerals are used for the common elements or components in the first and fifth embodiments, and the description of such elements or components for the fifth embodiment will be omitted. FIG. 8A shows a state where the head 291 of the double-headed piston 29 is located at the top dead center, and FIG. 8B shows a state where the head 292 of the double-headed piston 29 is located at the top dead center.

In the fifth embodiment, the rotary shaft 21 has grooves 42D and 430 formed and extending obliquely in the sealing surfaces 211 and 212 of the rotary shaft 21, respectively. The groove 42D extends obliquely such that it is directed in opposite direction to the rotational direction R of the rotary shaft 21 from the inlet 421 adjacent to the gap 44 toward the outlet 422 adjacent to the first communication passage 32. The groove 43D extends obliquely such that it is directed in opposite direction to the rotational direction R from the inlet 431 adjacent to the gap 45 toward the outlet 432 adjacent to the second communication passage 33. As in the previous embodiments, the outlet 422 of the groove 42D is located within the range of the first half of the angular width y of the first outlet 312, and the outlet 432 of the groove 430 is located within the range of the first half of the angular width 8 of the second outlet 313.

The obliquely extending grooves 42D and 43D allow the refrigerant in the grooves 42D and 43D to flow smoothly from the gaps 44 and 45 to the first and second communication passages 32 and 33 with the rotation of the rotary shaft 21. This allows increased amount of refrigerant flowing through the grooves 420 and 43D, so that the thrust bearings 25 and 26 are lubricated efficiently. Additionally, the fifth embodiment offers the advantages similar to those of the first embodiment.

The above embodiments may be modified in various ways as exemplified below.

The first embodiment may be modified such that the condition γ≠δ is satisfied.

In the first embodiment, the outlet 422 of the groove 42 may be connected to the second half of the first outlet 312 having the angular width γ, and the outlet 432 of the groove 43 may be connected to the second half of the second outlet 313 having the angular width δ.

The front housing 13 may be formed with a suction chamber from which refrigerant is introduced through the in-shaft passage 31 into the compression chambers 271 and 281.

Refrigerant may be introduced into the first and second supply passages 40 and 41 from a suction-pressure region located outside the compressor 10.

The first and second rotary valves 35 and 36 may be provided separately from the rotary shaft 21.

What is claimed:

1. A piston compressor, comprising:

a cylinder block having a shaft hole, a plurality of cylinder bores located around the shaft hole, and a plurality of communication passages communicating with associated cylinder bores and the shaft hole;

a rotary shaft inserted through the shaft hole and having an in-shaft passage formed therein;

a cam rotating integrally with the rotary shaft and accommodated in a cam chamber;

pistons accommodated in the respective cylinder bores to form therein compression chambers, the pistons being coupled to the rotary shaft through the cam so that rotating motion of the rotary shaft is transmitted to the pistons;

a thrust bearing provided between the cam and the cylinder block, the thrust bearing including a first race in contact with the cam, a second race in contact with the cylinder block, and rolling elements retained between the first and second races to form a gap therebetween;

a rotary valve formed integrally with the rotary shaft for introducing refrigerant into the compression chambers from the in-shaft passage, wherein the in-shaft passage has an outlet on the outer peripheral surface of the rotary shaft through which the in-shaft passage is communicated with the communication passages so that the refrigerant introduced into the compressor is delivered through the outlet of the in-shaft passage and the communication passages to the compression chambers; and an oil groove formed on the outer peripheral surface of the rotary shaft in its longitudinal direction, wherein the oil groove connects the gap and the outlet of the in-shaft passage which is spaced apart from the gap in the longitudinal direction.

2. The piston compressor according to claim 1, wherein the oil groove is connected to a first half of an opening of the outlet as seen in a rotational direction of the rotary shaft.

3. The piston compressor according to claim 1, wherein the outlet has a leading end as seen in a rotational direction of the rotary shaft, and the oil groove is located away from the leading end of the outlet as seen in the rotational direction of the rotary shaft.

4. The piston compressor according to claim 2, wherein the oil groove extends straight along a rotational axis of the rotary shaft.

5. The piston compressor according to claim 1, wherein the rotary shaft has a pair of the oil grooves extending parallel to each other.

6. The piston compressor according to claim 5, wherein the outlet of the in-shaft passage intermittently communicates with the communication passages as the rotary shaft rotates, an angular interval between the adjacent oil grooves is equal to or larger than an angular interval between the adjacent communication passages about a rotational axis of the rotary shaft, and the angular interval between the adjacent oil grooves is equal to or smaller than the sum of the angular interval between the adjacent communication passages and an angular width of the communication passage about the rotational axis of the rotary shaft.

7. The piston compressor according to claim 1, wherein the oil groove extends in opposite direction to a rotational direction of the rotary shaft as the oil groove extends from the gap toward the outlet of the in-shaft passage.

8. The piston compressor according to claim 7, wherein the oil groove extends obliquely from the gap toward the outlet of the in-shaft passage.

9. The piston compressor according to claim 1, wherein the cylinder block is provided by a first cylinder block having a plurality of first cylinder bores and a second cylinder block having a plurality of second cylinder bores, the pistons are of a double-headed type and accommodated in the associated first and second cylinder bores to form first compression chambers in the first cylinder bores and second compression chambers in the second cylinder bores, the rotary valve is provided by a first rotary valve for introducing refrigerant into the first compression chamber and a second rotary valve for introducing refrigerant into the second compression chamber, the outlet of the in-shaft passage is provided by a first outlet and a second outlet, the first and second rotary valves include the first and second outlets of the in-shaft passage, the refrigerant being introduced into the compressor and then delivered through the first and second outlets of the in-shaft passage to the first and second compression chambers, the thrust bearing is provided by a first thrust bearing interposed between the first cylinder block and the cam and a second thrust bearing interposed between the second cylinder block and the cam, the oil groove is provided by a first oil groove and a second oil groove, the first oil groove connects the gap in the first thrust bearing to the first outlet, and the second oil groove connects the gap in the second thrust bearing to the second outlet.

10. The piston compressor according to claim 9, wherein the rotary shaft has an end portion rotatably supported by the second cylinder block, the in-shaft passage has an inlet at the end portion, the refrigerant is introduced into the in-shaft passage through the inlet, and the cross-sectional area of the first oil groove is larger than the cross-sectional area of the second oil groove.

11. The piston compressor according to claim 10, wherein an angular width of the first oil groove about a rotational axis of the rotary shaft is larger than an angular width of the second oil groove about the rotational axis of the rotary shaft.

* * * * *